US011421524B2

(12) United States Patent
Duran

(10) Patent No.: US 11,421,524 B2
(45) Date of Patent: Aug. 23, 2022

(54) MONITORING THE CONDITION OF A DRILL STRING

(71) Applicant: Saudi Arabian Oil Company, Dhahran (SA)

(72) Inventor: Roberto Castillo Duran, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 102 days.

(21) Appl. No.: 16/927,198

(22) Filed: Jul. 13, 2020

(65) Prior Publication Data

US 2022/0010673 A1 Jan. 13, 2022

(51) Int. Cl.
*E21B 47/007* (2012.01)
*E21B 47/20* (2012.01)
*E21B 47/095* (2012.01)

(52) U.S. Cl.
CPC ..... *E21B 47/007* (2020.05); *E21B 47/095* (2020.05); *E21B 47/20* (2020.05)

(58) Field of Classification Search
CPC ..... E21B 47/00; E21B 47/006; E21B 47/007
See application file for complete search history.

(56) References Cited

U.S. PATENT DOCUMENTS 3,742,443 A * 6/1973 Foster ..... E21B 47/18 367/83
7,040,415 B2 5/2006 Boyle et al.
7,114,578 B2 10/2006 Hutchinson
7,140,452 B2 11/2006 Hutchinson
9,518,426 B2 12/2016 Tunget
10,364,663 B2 7/2019 Hohl et al.
10,472,944 B2 11/2019 Wassell
2012/0123757 A1 5/2012 Ertas et al.
2015/0233232 A1 8/2015 Rodney et al.
2017/0268324 A1 9/2017 Moore
2018/0023355 A1 1/2018 Teodorescu et al.
2020/0003611 A1 1/2020 Turner et al.

OTHER PUBLICATIONS

Yang et al., "Effect of annulus drilling fluid on lateral vibration of drillstring," Journal of Vibroengineering, Feb. 2020, 22(1):197-208, 12 pages.
PCT International Search Report and Written Opinion in International Appln. No. PCT/US2021/041239, dated Nov. 5, 2021, 15 pages.

* cited by examiner

*Primary Examiner* — Kristyn A Hall
(74) *Attorney, Agent, or Firm* — Fish & Richardson P.C.

(57) ABSTRACT

A method of determining the condition of a drill string includes receiving, by a processing device and from one or more sensors coupled to a portion of a drill string at or near a surface of a wellbore, noise information. The noise information represents drilling vibrations of the drill string during drilling of the wellbore. The method also includes determining, by the processing device based on the noise information, multiple vibration modes of the drill string. The method also includes comparing, by the processing device, the vibration modes to at least one vibration mode threshold. The method also includes determining, by the processing device based on the comparison of the vibration modes to the at least one vibration mode threshold, a condition of the drill string.

20 Claims, 3 Drawing Sheets

MONITORING THE CONDITION OF A DRILL STRING

FIELD OF THE DISCLOSURE

This disclosure relates to wellbores, in particular, to wellbore drilling strings.

BACKGROUND OF THE DISCLOSURE

During drilling operations, the drill string and other wellbore equipment can fail due to wear and other conditions. Detecting a condition of a drill string based on regular operation of the drill string can help prevent failure and save time and resources.

SUMMARY

Implementations of the present disclosure include a method that includes receiving, by a processing device from one or more sensors coupled to a portion of a drill string at or near a surface of a wellbore, noise information. The noise information represents drilling vibrations of the drill string during drilling of the wellbore. The method also includes determining, by the processing device based on the noise information, multiple vibration modes of the drill string. The method also includes comparing, by the processing device, the vibration modes to at least one vibration mode threshold. The method also includes determining, by the processing device based on the comparison of the vibration modes to the at least one vibration mode threshold, a condition of the drill string.

In some implementations, the drilling vibrations include drilling vibration modes. The drilling vibration modes include a first drilling vibration mode of a portion of the drill string submerged in drilling fluid and a second drilling vibration mode of a portion of the drill string not submerged in the drilling fluid.

In some implementations, receiving the noise information from the one or more sensors includes receiving, in real time, the noise information from the one or more sensors.

In some implementations, determining the condition of the drill string includes determining a value representing a level of fatigue of the drill string based on the comparison of the vibration modes to the at least one vibration mode threshold.

In some implementations, the one or more sensors are attached to a drilling sub residing above a saver sub of the drilling string. Receiving the noise information includes continuously receiving the noise information from the one or more sensors in real time.

In some implementations, determining the multiple vibration modes includes identifying vibration modes (surface noise) caused by drilling fluid pumped into the drill string. In some implementations, the method also includes identifying vibration modes caused by downhole forces during drilling, and eliminating the vibration modes caused by drilling fluid pumped into the drill string from the vibration modes. In some implementations, the vibration modes caused by downhole forces during drilling include one or more vibration modes caused by at least one of 1) excitation of the drill string, 2) axial force applied on the drill string, 3) lateral force applied on the drill string, 4) torsional vibrations of the drill string, 5) frequency of vibrations of the drill string, or 6) acceleration of vibrations of the drill string. In some implementations, the at least one vibration mode threshold represent at least one of 1) an excitation threshold, 2) an axial force threshold, 3) a lateral force threshold, 4) a torsional vibration threshold, 5) a vibration frequency threshold, or 6) a vibration acceleration threshold.

In some implementations, before comparing the vibration modes to a vibration mode threshold, the method includes generating pattern trends for vibration modes caused by downhole forces during drilling. The method also includes determining acceleration vibration modes caused by downhole forces during drilling. The vibration acceleration modes are associated with detrimental conditions in the drill string. The method also includes determining, based on the pattern trends and the defined acceleration vibration modes, the at least one vibration mode threshold. The method also includes comparing the determined vibration modes to the at least one vibration mode threshold, and determining, based on the comparison, the condition of the drill string. In some implementations, the method also includes determining, based on the comparison, acceleration vibration modes close to the at least one vibration mode threshold, and determining, based on the comparison, operating windows for operating parameters under abnormal conditions.

Implementations of the present disclosure also include a method that includes receiving, by a processor and from at least one sensor coupled to a portion of a drill string residing at or near a surface of a wellbore, vibration noise information representing vibrations of the drill string. The method also includes determining, by the processor and based on the vibration noise information, a vibration mode of the drill string. The method also includes determining, by the processor, based on the vibration noise information and based on parameters of the drill string, a vibration threshold. The method also includes comparing, by the processor, the vibration mode to the vibration mode threshold. The method also includes determining, by the processor based on the comparison of the vibration mode to the vibration threshold, a condition of the drill string.

In some implementations, the drilling vibrations include drilling vibration modes. The drilling vibration modes include a first drilling vibration mode of a portion of the drill string submerged in drilling fluid and a second drilling vibration mode of a portion of the drill string not submerged in the drilling fluid.

In some implementations, the parameters of the drill string include at least one of a material of the drill string, a length of the drill string, a type of bottom hole assembly, a type of drill bit, revolutions per minute, or weight on bit.

In some implementations, determining the condition of the drill string includes determining a value representing a level of fatigue of the drill string based on the comparison of the vibration mode to the vibration mode threshold.

Implementations of the present disclosure include a system that has one or more sensors attached to a portion of a drill string at or near a surface of a wellbore. The system also includes a processor communicatively coupled to the one or more sensors, and a memory communicatively coupled to the processor. The memory stores instructions which, when executed, cause the processor to perform operations that include: receive, from the one or more sensors, noise information representing drilling vibrations of the drill string during drilling. The operations also include determine, based on the noise information, vibration modes of the drill string. The operations also include comparing the vibration modes to at least one vibration mode threshold, and determine, based on the comparison of the vibration modes to the vibration mode threshold, a condition of the drill string.

In some implementations, the system includes a drilling sub residing above a saver sub of a top drive system of the drill string. The one or more sensors are attached to a bore of the drilling sub to sense vibration noise of the drill string during drilling.

In some implementations, the one or more sensors sense vibration noise of a first portion of the drill string submerged in drilling fluid and vibration noise of a second portion of the drill string not submerged in the drilling fluid. The processor determines which vibration noise is originated from the first portion and which vibration noise is originated from the second portion.

In some implementations, determining the condition of the drill string includes determining, based on the comparison of the vibration modes to the vibration threshold, a fatigue of the drill string.

In some implementations, the system also includes an electronic interface device including the processor and residing at or near the surface of the wellbore, the electronic interface device displays a curve in an electronic interface representing a fatigue of the drill string.

In some implementations, the operations further include identifying vibration noise caused by drilling fluid pumped into the drill string, and eliminating the vibration noise caused by drilling fluid pumped into the drill string to process the vibration noise caused by downhole forces during drilling.

DETAILED DESCRIPTION OF THE DISCLOSURE

The present disclosure describes a system for detecting or predicting failure of a drill string. The system includes one or more vibration sensors incorporated in a sub disposed uphole of a saver sub in the top drive system (TDS) that is at the surface of the wellbore. The sensors sense different vibration modes coming up from the drill string resultant of the drill string parameters and dynamics. The sensors transmit the information to a processing device. The processing device determines which vibration modes correspond to a portion of the drill string that is submerged in drilling fluid and which vibration modes correspond to a portion of the drill string that is not submerged in the drilling fluid. Based on that determination, the processing device identifies which vibration modes lead to drill string failure based on a level of fatigue of the drill string. The processing device can generate a curve representing the fatigue of the drill string for an operator to perform preventive operations.

Particular implementations of the subject matter described in this specification can be implemented so as to realize one or more of the following advantages. For example, detecting and predicting possible failure of a drill string in real time during normal operating parameters of a drill string can save time and resources.

Figure 1:
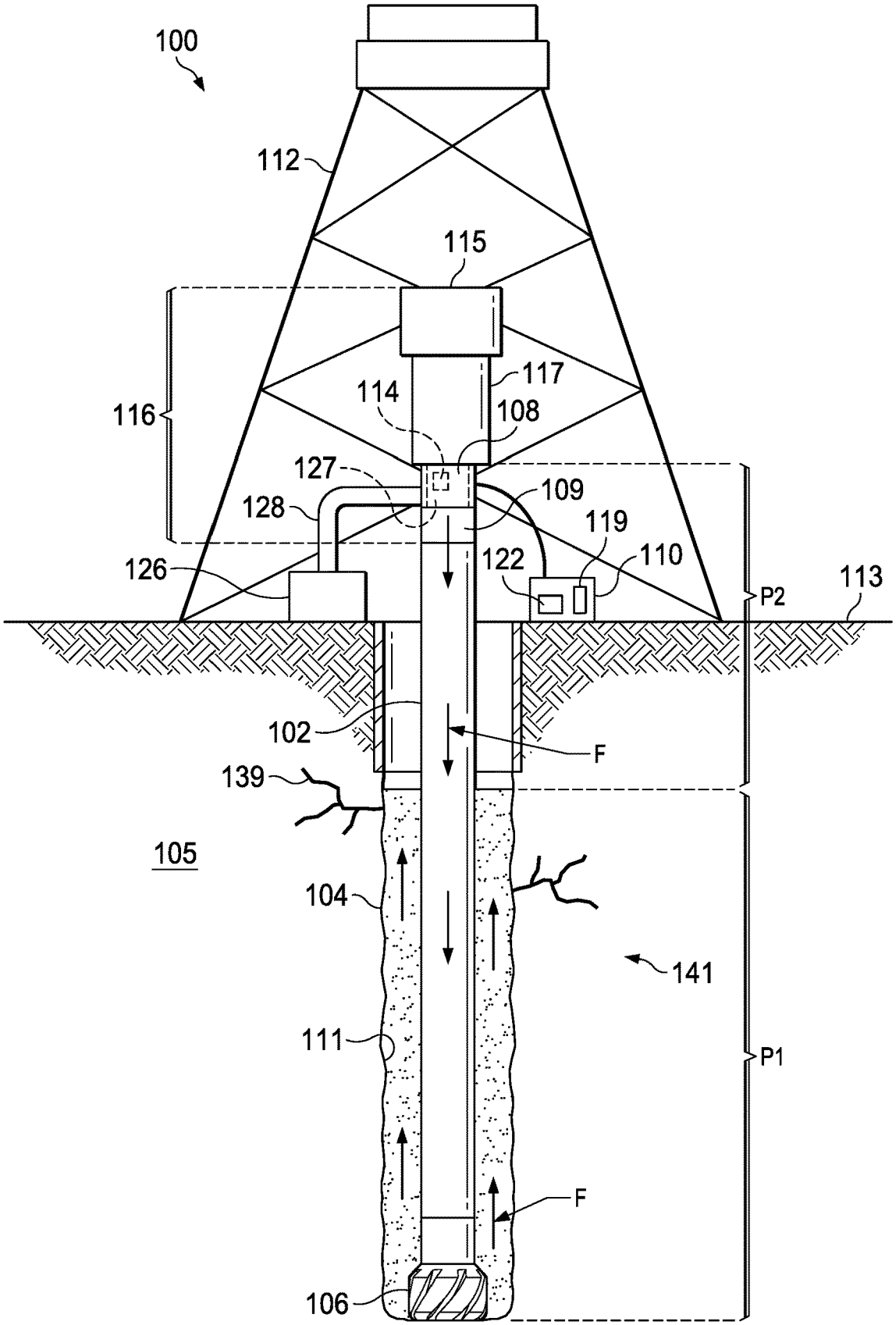
FIG. 1 is a front schematic view, partially cross sectional, of a failure detection system implemented in a drill string.

FIG. 1 shows a failure detection system 100 implemented in a drill string 102. The drill string 102 drills and is disposed within a wellbore 104 formed in a geologic formation 105. The drill string 102 includes a drill bit 106 residing at a downhole location of the drill string 102. The drill string 102 flows drilling fluid 'F' from or near a surface 113 of the wellbore 104 to the drill bit 106. The drill bit 106 ejects the drilling fluid 'F' at a downhole location of the wellbore 104, which then travels up an annulus 111 to or near the surface 113 of the wellbore 104 to be flown back into the drill string 102. The failure detection system 100 detects or predicts failure of the drill string 102 based on the 'actual' vibration sound of the drill string 102, without changing or modifying operating parameters of the drill string 102.

The drill bit 106 and the drill string 102 are subject to forces that can cause failure of the drill string 102 or the drill bit 106 or both. For example, the drill string 102 can be modeled as spring fixed on both ends. During drilling, the drill bit 106 and at least part of a bottom hole assembly of the drill string 102 are in compression, due to the force applied to the drill bit 106 from the surface 113 of the wellbore 104 to break the formation 105. Some of the same force and other drilling forces (for example, excitation from torsional forces) travel back to the surface to be sensed by the failure detection system 100 to determine a condition of the drill string 102.

The failure detection system 100 can include a drilling sub 108 or sensor sub and an electronic interface device 110 communicatively coupled to the drilling sub 108. The drilling sub 108 can be part of a top drive system (TDS) 116 that is attached to the drill string 102 to provide torque and axial force to the drill string 102. The TDS 116 is coupled to a drilling rig 112 residing at the surface 113 of the wellbore 104. The TDS 116 can include a motor 115, a gearbox 117 coupled to the motor 115, the drilling sub 108 coupled to the gearbox 117, and a saver sub 109 disposed underneath the saver sub 109.

The drilling sub 108 can be a tube threadedly attached to the gear box 117 (or to another sub attached to the gear box 117) at one end and threadedly attached to the saver sub 109 at an opposite end. The drilling sub has one or more sensors 114 disposed inside and attached to a bore 127 of the drilling sub 108. The sensors 114 are communicatively coupled to electronic interface device 110. The sensors 114 sense vibration noise of the drill string 102 during drilling and send the vibration information to the electronic interface device 110. The sensors can send the information in real time. In example implementations, "real time" means that a duration between receiving an input and processing the input to provide an output can be minimal, for example, in the order of seconds, milliseconds, microseconds, or nanoseconds, sufficiently fast allow the processor 122 to determine a condition of the drill string 102 to prevent failure of the drill string 102.

The drilling sub 108 can be fluidically coupled to a mud pump 126 that pumps, through a pipe 128, the drilling fluid 'F' into the drill string 102. The drilling fluid 'F' flows, through the drill string 102, from the surface 113 of the wellbore 104 to the drill bit 106. The drilling fluid 'F' leaves the drill string 102 through the drill bit 106 and flows in an uphole direction through an annulus 111 to a loss circulation zone 141 that can include fractures 139 where the drilling fluid 'F' is lost. Because the drilling fluid 'F' may not come up the annulus 111 to the surface, only a portion of the drill string 102 may be submerged in drilling fluid.

The electronic interface device 110 resides at or near the surface 113 of the wellbore 104. For example, the electronic interface device 110 can be a computer used by an operator to monitor the condition of the drill string 102. In some cases, the electronic interface device 110 can be a mobile computing device (for example, a smartphone) wirelessly coupled to the drilling sub 108. In some implementations, the electronic interface device 110 can be electrically coupled to the drilling sub 108 to provide power to the drilling sub 108. The electronic interface device 110 includes a processing device 122 (for example, a processor) that receives and processes the vibration data from the sensors 114. In some cases, the failure detection system 100 can only include a processor 122 (e.g., without an electronic interface device) communicatively coupled to sensors 114 that are attached to a portion of the drill string 102 at or near the surface 113 of the wellbore 104. In such implementations, the processor 122 can be electrically coupled to an alarm system that notifies an operator about the condition of the drill string 102.

During drilling, a first portion 'P1' of the drill string 102 is submerged in the drilling fluid 'F' (for example, in the drilling fluid disposed in the annulus 111) and a second portion 'P2' of the drill string 102 is not submerged in the drilling fluid 'F'. The sensors 114 sense vibration noise associated with the first portion 'P1' and vibration noise associated with the second portion 'P2'. To determine which vibration noise comes from the first portion 'P1' and which vibration noise comes from the second portion 'P2' (e.g., to identify the sound wave origin), the processor 122 analyzes the wave shape of each sound wave, determines the refraction and distortion of every wave spectrum, and determines the arrival time of each sound wave with respect to wave shape and the parameters of the wave spectrum. In other words, the processor 122 compares the arrival time of each type of sound wave with one or more thresholds to determine which sound waves originated from a media in liquid, i.e., from the first portion 'P1' submerged in the drilling fluid 'F', and which sound waves originated from a media surrounded by air, i.e., from the second portion 'P2' exposed to the ambient air. The processor 122 can consider the amount of attenuation of each sound wave to determine which portion of the drill string 102 is submerged in fluid. Sound waves coming from the non-submerged part of the drill string 102 may arrive at the drilling hub 108 before the sound waves from the submerged portion and in a very erratic shape, because of the lack of attenuation or damping that is otherwise provided by the drilling fluid to the submerged portion. By determining which sound waves come from the submerged and non-submerged portions of the drill string 102, the processor 122 can compare the values of each portion to thresholds that are specific to the corresponding portion of the drill string 102 to accurately determine the condition of each portion 'P1' and 'P2' of the drills string 102.

The processor 122 receives the noise information from the sensors 114. The noise information represents drilling vibrations of the drill string 102 during drilling. Specifically, the noise information represents drilling vibrations of the first portion 'P1' of the drill string 102 and drilling vibrations of the second portion 'P2' of the drill string 102. The processor 122 determines, based on the noise information, one or more vibration modes of the drill string 102. The drilling vibration modes include at least a drilling vibration mode of the first portion 'P1' and a drilling vibration mode of the second portion 'P2' of the drill string 102. The vibration modes can include at least one of 1) excitation of the drill string, 2) axial force applied on the drill string, 3) lateral force applied on the drill string, 4) torsional vibrations of the drill string, 5) frequency of vibrations of the drill string, or 6) acceleration of vibrations of the drill string. In some implementations, the drill string behavior is evaluated in three different vibration modes: axial vibration mode, torsional vibration mode, and lateral vibration mode. In some implementations, the processor 122 compares the frequency and amplitude of the noise waves in each vibration mode to appropriate frequency and amplitude thresholds to determine the condition of the drill string 102.

The processor 122 can determine in real time which portion (e.g., what length) of the drill string 102 is submerged in drilling fluid 'F' (as the level of the drilling fluid changes) and determine, based on predetermined damping properties of the drill string under submerged conditions, the condition of drill string 102.

Additionally, the processor 122 identifies the vibration modes caused by drilling fluid 'F' pumped into the drill string by the pump 126 and identifies the vibration modes caused by downhole forces during drilling. Upon identifying the vibration modes, the processor 122 eliminates the vibration modes caused by drilling fluid pumped into the drill string 102 and determines the condition of the drill string 102 based on the vibration modes caused by downhole forces during drilling.

To determine appropriate thresholds, the processor 122 can process several field measurements using different bottom hole assemblies (BHAs) and drill bits to determine the base lines and vibration modes and to identify the stress accumulation points in the drill string 102. This is done because different BHAs may behave differently depending on their configuration, depth, level of fluid, type of drill bit, type of formation, and other parameters and conditions. The processor 122 identifies such values out of the set threshold limits after several measurements. Such thresholds can be used for a common drill string using different drill bits and BHAs as required during drilling. Furthermore, the processor 122 can generate pattern trends for vibration modes caused by downhole forces during drilling. The processor 122 determines acceleration vibration modes caused by downhole forces during drilling. The vibration acceleration modes are associated with detrimental conditions in the drill string 102. The processor 122 can use the vibration acceleration modes and the pattern trends to determine at least one vibration mode threshold. The thresholds can be used by the processor 122 to determine a condition of the wellbore and to determine operating windows for operating parameters of the drill string 102 under abnormal conditions.

After determining the vibration modes detected in the drill string 102 and determining an appropriate threshold, the processor 122 compares the multiple vibration modes to at least one vibration mode threshold. For example, the vibration mode threshold can be based on safe zones' of the drill string under certain conditions. Such safe zones can be determined based on the weight on bit (WOB), revolutions per minute (RPM) of the drill string and drill bit, and the drilling fluid level. The vibration mode thresholds can include excitation threshold, 2) an axial force threshold, 3) a lateral force threshold, 4) a torsional vibration threshold, 5) a vibration frequency threshold, 6) and a vibration acceleration threshold. The processor 122 determines, based on the comparison of the vibration modes to the vibration mode threshold, a condition of the drill string 102. In some implementations, determining the condition of the drill string 102 means determining, based on the comparison of the vibration modes to the vibration mode threshold, a fatigue of the drill string 102. The electronic interface device 110 can have a graphical user interface 119 in which the interface device 110 displays a curve representing a fatigue of the drill string 102. The graphical user interface 119 can display charts and curves based on the measurements. The curves or charts can show values of RPM vs WOB or g-force of acceleration.

Figure 2:
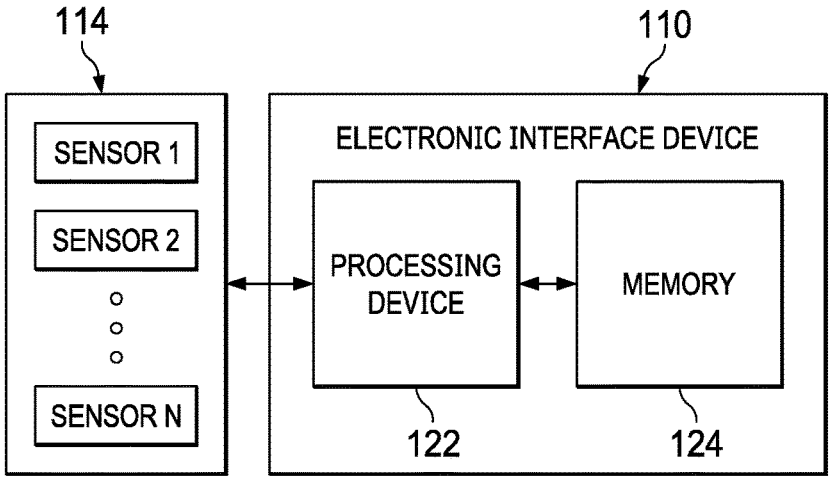
FIG. 2 is a block diagram of a failure detection system for a drill string.

FIG. 2 illustrates a block diagram of an example failure detection system. The system includes electronic interface device 110 and a group of sensors 114. Electronic interface device 110 includes a processing device 122 and a memory 124 communicatively coupled to processing device 122. Sensors 114 are communicatively coupled to processing device 122 to send vibration noise information to the processing device 122. The memory 124 stores information about the wellbore and drill string (e.g., drill string parameters such as material and dimensions of the drill string) and instructions which, when executed, cause the processor to compute a number representing a condition of the wellbore, based on vibration noise of the drill string during normal drilling operations.

Figure 3:
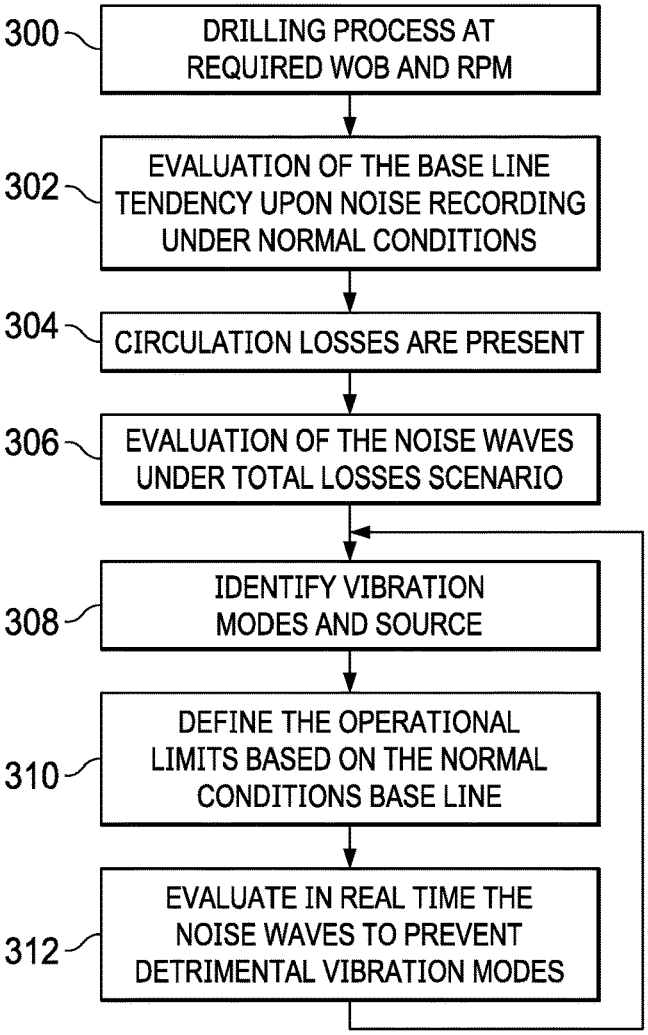
FIG. 3 is a flow chart of an example method of determining vibration modes that are detrimental to the drill string.

FIG. 3 illustrates a flow chart of an example process of evaluating vibration noise to determine which vibration modes are detrimental to the drill string 102. For example, the process of FIG. 3 may be used to establish appropriate operating thresholds for the processor to use during monitoring of the drill string. The process begins by drilling a wellbore using required parameters such as WOB and RPMs of the drill bit and drill string (300). The process then includes determining and evaluating a base line tendency based on recording vibration noise under normal conditions (302). Normal conditions can be present when the drill string is not subject to abnormal conditions (e.g., lost circulation, abnormal pressure, salt water flow, domal formation, heaving shale, or sticking of drill pipe). The base line includes vibration modes and vibration sound during normal drilling conditions. The process then includes determining that circulation losses are present (304). Circulation losses are present when all or part of the drilling fluid is lost to high-permeability zones, cavernous formations, or fractures (natural or induced fractures) formed during drilling. The process then includes evaluating the noise waves under a total losses scenario (306). A total losses scenario may be present when the drilling fluid does not reach the surface of the wellbore due to circulation losses that leaves at least part of the drill string exposed to external ambient air (a non-submerged portion of the drill string). The process then includes identifying vibration modes and the source of the vibration modes (308). The process then includes defining, based on the normal conditions base line, operational limits or thresholds of the drill string (310). The process then includes evaluating the noise waves of the drill string (e.g., comparing the noise waves under abnormal conditions to the noise waves under normal condition) to determine which vibration modes are detrimental to the drill string (312).

Figure 4:
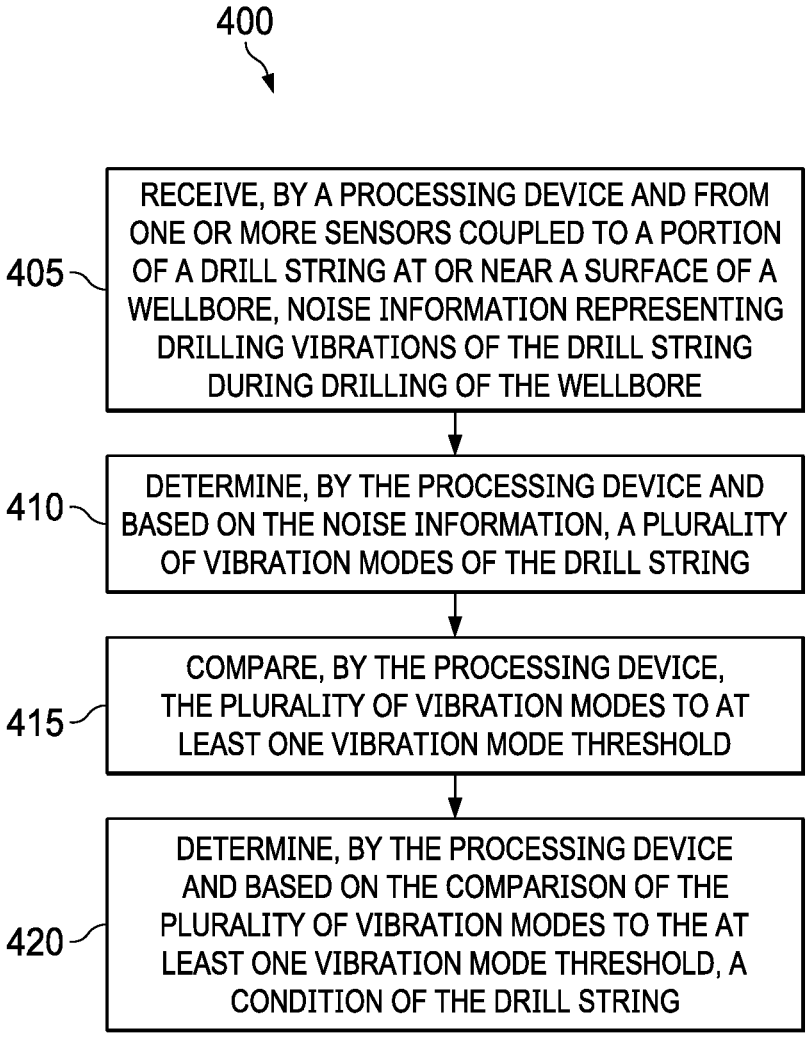
FIG. 4 is a flow chart of an example method of determining a condition of a drill string.

FIG. 4 shows a flow chart of an example method 400 of determining a condition of a drill string. The method includes receiving, by a processing device and from one or more sensors coupled to a drill string disposed within a wellbore, noise information representing drilling vibrations of the drill string during drilling of the wellbore (405). The method also includes determining, based on the noise information, multiple vibration modes of the drill string (410). The method also includes comparing, by the processing device, the multiple vibration modes to at least one vibration mode threshold (415) and determining, by the processing device and based on the comparison of the plurality of vibration modes to the at least one vibration mode threshold, a condition of the drill string (420).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A method comprising:

receiving, by a processing device and from one or more sensors coupled to a portion of a drill string at or near a surface of a wellbore, noise information representing drilling vibrations of a first portion of the drill string submerged in drilling fluid during drilling of the wellbore and drilling vibrations of a second portion of the drill string not submerged in drilling fluid during drilling of the wellbore;

determining, by the processing device, first vibration noise originated from the first portion and second vibration noise originated from the second portion;

determining, by the processing device and based on the first vibration noise and the second vibration noise, a plurality of vibration modes of the drill string;

comparing, by the processing device, the plurality of vibration modes to at least one vibration mode threshold; and determining, by the processing device and based on the comparison of the plurality of vibration modes to the at least one vibration mode threshold, a condition of the drill string.

2. The method of claim 1, wherein receiving the noise information from the one or more sensors comprises receiving, in real time, the noise information from the one or more sensors.

3. The method of claim 1, wherein determining the condition of the drill string comprises determining a value representing a level of fatigue of the drill string based on the comparison of the plurality of vibration modes to the at least one vibration mode threshold.

4. The method of claim 1, wherein the one or more sensors are attached to a drilling sub residing above a saver sub of the drilling string, and wherein receiving the noise information comprises continuously receiving the noise information from the one or more sensors in real time.

5. The method of claim 1, wherein determining the plurality of vibration modes comprises:

identifying vibration modes caused by drilling fluid pumped into the drill string;

identifying vibration modes caused by downhole forces during drilling; and eliminating the vibration modes caused by drilling fluid pumped into the drill string from the plurality of vibration modes.

6. The method of claim 5, wherein the vibration modes caused by downhole forces during drilling comprise one or more vibration modes caused by at least one of 1) excitation of the drill string, 2) axial force applied on the drill string, 3) lateral force applied on the drill string, 4) torsional vibrations of the drill string, 5) frequency of vibrations of the drill string, or 6) acceleration of vibrations of the drill string.

7. The method of claim 6, wherein the at least one vibration mode threshold represent at least one of 1) an excitation threshold, 2) an axial force threshold, 3) a lateral force threshold, 4) a torsional vibration threshold, 5) a vibration frequency threshold, or 6) a vibration acceleration threshold.

8. The method of claim 5, further comprising, before comparing the plurality of vibration modes to a vibration mode threshold:

generating pattern trends for vibration modes caused by downhole forces during drilling;

determining acceleration vibration modes caused by downhole forces during drilling, the vibration acceleration modes associated with detrimental conditions in the drill string;

determining, based on the pattern trends and the defined acceleration vibration modes, the at least one vibration mode threshold;

comparing the determined plurality of vibration modes to the at least one vibration mode threshold; and determining, based on the comparison, the condition of the drill string.

9. The method of claim 8, further comprising:

determining, based on the comparison, acceleration vibration modes close to the at least one vibration mode threshold; and determining, based on the comparison, operating windows for operating parameters under abnormal conditions.

10. The method of claim 1, wherein determining the plurality of vibration modes of the drill string comprises determining at least one of a first drilling vibration mode of the first portion of the drill string or a second drilling vibration mode of the second portion of the drill string.

11. A method comprising:

receiving, by a processor and from at least one sensor coupled to a portion of a drill string residing at or near a surface of a wellbore, vibration noise information comprising vibrations of a first portion of the drill string submerged in drilling fluid and vibrations of a second portion of the drill string not submerged in the drilling fluid;

determining, by the processor, first vibration noise originated from the first portion and second vibration noise originated from the second portion;

determining, by the processor and based on the first vibration noise and second vibration noise, a vibration mode of the drill string;

determining, by the processor, based on the first vibration noise, second vibration noise, and parameters of the drill string, a vibration threshold;

comparing, by the processor, the vibration mode to the vibration threshold; and determining, by the processor and based on the comparison of the vibration mode to the vibration threshold, a condition of the drill string.

12. The method of claim 11, wherein the parameters of the drill string include at least one of a material of the drill string, a length of the drill string, a type of bottom hole assembly, a type of drill bit, revolutions per minute, or weight on bit.

13. The method of claim 11, wherein determining the condition of the drill string comprises determining a value representing a level of fatigue of the drill string based on the comparison of the vibration mode to the vibration threshold.

14. The method of claim 11, wherein determining the plurality of vibration modes of the drill string comprises determining at least one of a first drilling vibration mode of the first portion of the drill string or a second drilling vibration mode of the second portion of the drill string.

15. A system comprising:

one or more sensors attached to a portion of a drill string at or near a surface of a wellbore;

a processor communicatively coupled to the one or more sensors; and a memory communicatively coupled to the processor, the memory storying instructions which, when executed, cause the processor to perform operations including:

receive, from the one or more sensors, information representing vibration noise of a first portion of the drill string submerged in drilling fluid during drilling and vibration noise of a second portion of the drill string not submerged in the drilling fluid during drilling;

determine which vibration noise is originated from the first portion and which vibration noise is originated from the second portion;

determine, based on the determination of which vibration noise is originated from the first portion and which vibration noise is originated from the second portion, a plurality of vibration modes of the drill string;

compare the plurality of vibration modes to at least one vibration mode threshold; and determine, based on the comparison of the plurality of vibration modes to the vibration mode threshold, a condition of the drill string.

16. The system of claim 15, further comprising a drilling sub residing above a saver sub of a top drive system of the drill string, the one or more sensors attached to a bore of the drilling sub and configured to sense vibration noise of the drill string during drilling.

17. The system of claim 15, wherein determining the condition of the drill string comprises determining, based on the comparison of the plurality of vibration modes to the vibration mode threshold, a fatigue of the drill string.

18. The system of claim 15, further comprising an electronic interface device including the processor and residing at or near the surface of the wellbore, the electronic interface device configured to display a curve in an electronic interface representing a fatigue of the drill string.

19. The system of claim 15, wherein the operations further include:

identifying vibration noise caused by drilling fluid pumped into the drill string; and eliminating the vibration noise caused by drilling fluid pumped into the drill string to process the vibration noise caused by downhole forces during drilling.

20. The system of claim 15, wherein the operations further comprise:

determine a first drilling vibration mode of the first portion of the drill string and a second drilling vibration mode of the second portion of the drill string.

* * * * *